US005338199A

United States Patent [19]

Euer et al.

[11] Patent Number: 5,338,199

[45] Date of Patent: Aug. 16, 1994

[54] AERIAL TOW TARGET

[75] Inventors: Hartmut Euer; Wilfried Baues, both of Penzberg; Joachim Wernicke, Berlin, all of Fed. Rep. of Germany

[73] Assignee: Ingenieurburo fur Elektro-Mechanische Technologien Dipl-Ing Hartmut Euer, Fed. Rep. of Germany

[21] Appl. No.: 976,962

[22] Filed: Nov. 16, 1992

[30] Foreign Application Priority Data

Nov. 19, 1991 [DE] Fed. Rep. of Germany ..... 4138726

[51] Int. Cl.[5] ..... G09B 19/00; F41J 9/08

[52] U.S. Cl. ..... 434/14; 273/360

[58] Field of Search ..... 273/317, 360, 361; 434/14

[56] References Cited

U.S. PATENT DOCUMENTS

| | | | |
|---|---|---|---|
| 1,860,982 | 5/1932 | Binnie | 273/360 |
| 2,238,876 | 4/1941 | Manson . | |
| 2,269,469 | 1/1942 | Manson | 273/360 |
| 2,807,287 | 9/1957 | Frey | 273/360 |
| 3,000,634 | 9/1961 | South | 273/360 |
| 4,540,987 | 9/1985 | Werkes et al. . | |

FOREIGN PATENT DOCUMENTS

| | | | |
|---|---|---|---|
| 0124785 | 4/1983 | European Pat. Off. . | |
| 2604929 | 8/1977 | Fed. Rep. of Germany | 273/360 |
| 3312820 | 10/1984 | Fed. Rep. of Germany | 273/360 |
| 496230 | 10/1919 | France | 273/360 |
| 1435960 | 3/1965 | France . | |
| 2034267 | 9/1979 | United Kingdom . | |

*Primary Examiner*—Gene Mancene
*Assistant Examiner*—Cindy A. Cherichetti
*Attorney, Agent, or Firm*—Parmelee, Bollinger & Bramblett

[57] ABSTRACT

The invention relates to a high speed aerial tow bag target of textile material having a reduced aerodynamic drag provided with a frontside air entrance orifice and at least one air exit orifice at its tail. In order to reduce the drag of the tow bag and to improve its stability under flight condition the tail is provided with a contour tapering to the end of the bag and the hole area of the air exit orifices is made smaller than the cross section of the air entrance orifice at the front side.

5 Claims, 3 Drawing Sheets

AERIAL TOW TARGET

FIELD OF THE INVENTION

The invention relates to a high speed aerial tow target of textile material having a reduced aerodynamic drag provided with a front side air entrance aperture and at the backside at least one air exit aperture.

This kind of tow targets consisting generally of natural or artificial textile material are towed behind an aircraft and are used as aerial targets for the exercising shooting onto flying targets, wherein a shot receiving sensor means installed within the tow target recognizes the projectiles passing the target and indicating them in form of a shot sign on the earth. Besides the so called smooth tow target of textile materials also so called solid tow targets are used the last ones are configured as rigid aerial trailers.

DESCRIPTION OF THE PRIOR ART

The known smooth or soft tow targets are in general tow bags of the above mentioned kind which are pretensioned and kept stable in configurational aspects by the static pressure of the impinging air stream and which are advantageous in economical aspects in comparison to aerial trailers and deliver a greater security against damages on striking the ground, if these trailers are shot off or pulled down.

A disadvantage of the tow bag targets in relation to the aerial trailers is manifested by the fact that the first ones cannot carry with them smoke cartridges marking the tow target after having been remotely ignited. Because of security reasons, however, the tow targets must be definitely recognized in order to avoid under all circumstances any confusion between such a tow target and the air-craft towing that target. Therefore, tow bag targets must be essentially greater in size than aerial trailers in order to provide a sufficient visibility and thus distinctiveness. The relatively great dimensions, however, have the drawback of an increased drag or air resistance which is for a definite tow speed in general ten to twenty times greater than that of aerial trailers. The drag, however, is the essential feature for the maximum speed of use of a tow target, because the tensile strength of the tow ropes and the reserve power of towing the aircraft are limited.

The high drag of usual tow bag targets, however, is not only caused by their great dimensions, but also by an aerodynamically unfavorable configuration and flowing conditions. This configuration is characterized therein that the tow bags of in general circular cylindrical form are open at the front side and are closed at the back side by a flat cylinder. The impinging flow enters the front side aperture which is kept open perpendicularly to the impinging flow by numerous strings of even length, the so called spider. The air entering the front side aperture produces a static pressure inflating the tow bag target. The tensile strings are concentrated into a tow rope and are connected thereto by a rope coupling.

This construction of the tow bag target which is usual in the practice causes essential air turbulences in the front area as well as at the tail which are the essential reason for the high tow resistance or drag. Especially at the rear wall extending nearly perpendicularly to the longitudinal axis of the bag the air flow is interrupted and turbulence is caused over the whole area.

In case of the usual equipment provided with the acoustical shot sensor means in the front area of the tow bag it is necessary to diminish the front side air turbulence and thus the acoustical background noise. This is reached by means of a circle of relatively small radial orifices in the rear bag wall, through which the impinging air stream is partly flowing so that the front side turbulences are diminished. On the other hand the lateral blowing out of the air through these orifices increases the drag but it is favorable insofar as it stabilizes the flight condition, as such a kind of tow bags is usually rotating about its longitudinal axis because of unsymmetrical manufacturing tolerances. This rotation, however, is to be avoided, because it causes a changing orientation and a lateral impinging stream onto the acoustical shot sensors affecting the correct operation of the system.

It was found out that tow bags having the above mentioned lateral rear circle of orifices rotate slower than those which are not provided with such a circle of orifices, because the laterally emerging air flows have an effect retarding rotation. The problem, however, that the air resistance or drag is too high cannot be solved by such a kind of tow bags, because the dimensions of the tow bags must be maintained so great as in case of bags without a circle of orifices at the tail.

It is certainly true that a rotation retarding effect can be provided by making the configuration of the tow bag from the front side to the rear in a slight conically expanding manner. By such a configuration, however, the drag is increased and manufacturing of such a conically configured tow bag requires a special accuracy and symmetry, because such a kind of tow bags are combined by seaming trapezoidal cuts of textile material so that not-parallel weaving threads are extending generally along the seams.

SUMMARY OF THE INVENTION

One of the objects underlying the invention is therefore to provide a tow bag target which is especially useful for high speed purposes.

According to another object such a tow bag target should have an improved configuration resulting in a reduced drag or resistance on towing it through the air.

According to a still further object of the invention the tow bag target of the above mentioned kind is to be constructed such that under flight condition the position of the tow bag target with respect to its longitudinal axis is maintained stable.

DETAILED DESCRIPTION OF THE INVENTION

These and other objects are advantageously solved by the invention by the fact that the tail of the tow bag target is provided with a tapering contour in the direction to the bag end and that the whole area of the air outlet orifices at the tail end is smaller than the cross section of the air entrance orifice at the front side.

The solution of these objects is based on the consideration that in case the tow bag target is manufactured in a highly precise manner it should be possible to maintain the target generally in a stable position by means of a mass pendulum, for instance the arrangement of a shot sensor electronic device within the tow bag wall and thus in an eccentric position, in order to completely or partly avoid the usual radial arrangement of orifices at the tail positioned on a circular line. Instead thereof one or several axially directed throughput orifices are arranged in the tail of the tow bag in order to essentially diminish the increasing resistance caused by blowing out the air radially and laterally or to completely avoiding it, if possible.

A precondition for the stability of the configuration of the tow bag target is that the whole area of the air outlet orifice at the tail is smaller than the air entrance orifice of the tow bag target at its front side. If this condition is not fulfilled, flutter movements of the bag walls are caused disturbing the operation and increasing extremely the resistance of moving or towing as well as the acoustical background noise. These drawbacks can because of local mechanical overstresses destroy the textile material of the tow bag target.

By a converging, i.e. tapering configuration of the tail of the tow bag target break-off of the flow increasing the flow resistance is avoided. In this connection, the flow through of the axially directed air exit orifices is used to maintain the conical configuration of the tail of the tow bag in a stable condition by means of the developing static pressure. The straight direction of flow through the bag with only few turbulences make it possible in this connection to concentrate the emerging air in a manner without raising fluid break-off and turbulences during flow around the tail area of the bag.

The required effect by using the characterized construction of the tow air target by means of a special configuration of the cross section of the through flow orifices at the tail of the bag can be gained by means of a single axial hole of circular configuration as well as by means of other configurations. Moreover, an arrangement of several orifices may be suitable. Moreover, a larger area of orifices may be divided by a netlike web or fabric into several single orifices. The converging contour of the tow bag in the direction of its tail may be advantagously realized by a conical or rotational-elliptical or spherical configuration. The progressive tapering of the tail of the tow bag target increase, however, the danger of flutter movements of the textile material at the tail end as a result of the decreasing difference between a local inner pressure and the outer pressure. As a result of such flutter movements periodical changes of the through flow cross section are caused which are disadvantageously affecting the stability of the flight, the tow resistance and the acoustical background noise level. In order to avoid such flutter movements the air exit or section of the orifices can be stabilized in configurational aspects by means of a solid annulus or ring fixed to the textile tow bag tail, for instance sewed into the textile material and tensioned at the tow bag wall by means of tensioning strings in order to avoid a lateral oscillation.

In order to gain a high accuracy and symmetry on manufacturing the tow bag target it is preferably provided in precise cylindrical configuration. On doing so it is possible to maintain constantly a parallel main weaving thread direction of the textile material over the whole circumference of the tow bag target and to minimize seam deformations because of a sloping run of the thread along the seams of the tow bag.

Such a tow bag target has the advantage that the flight condition can be made stable by means of a pendulum, i.e. or the arrangement of the shot sensor electronic device within the tow bag wall out of the axial position and it has nevertheless a reduced drag or tow resistance because the air stream is largely free of turns and turbulences. In case an accurate cylindrical construction is wanted the additional advantage of simpler manufacture may be gained.

DESCRIPTION OF THE DRAWINGS

The invention will be explained in more detail with reference to the embodiments shown in the drawings, in which.

Figure 1:
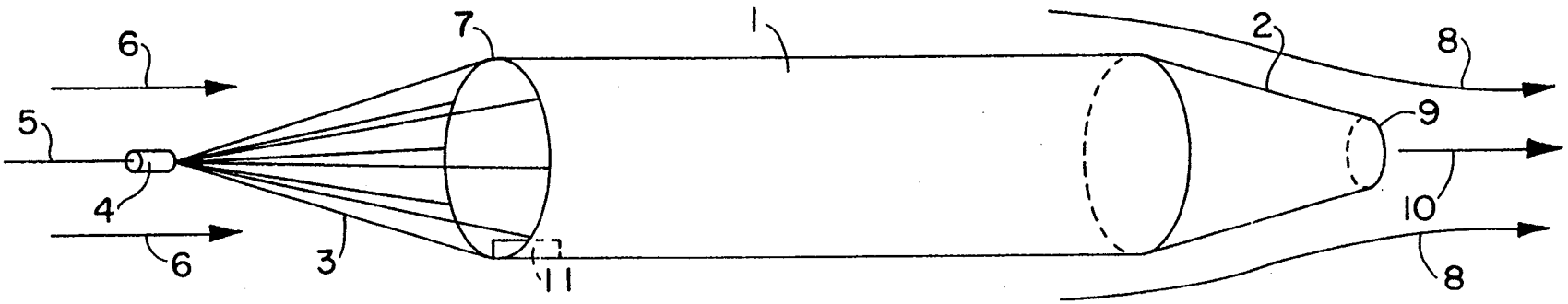
FIG. 1 is a schematical lateral view of a cylindrical tow bag target provided with a conically tapering contour of the tail of the bag and with an axial-symmetrical air exit orifice.
Figure 2:
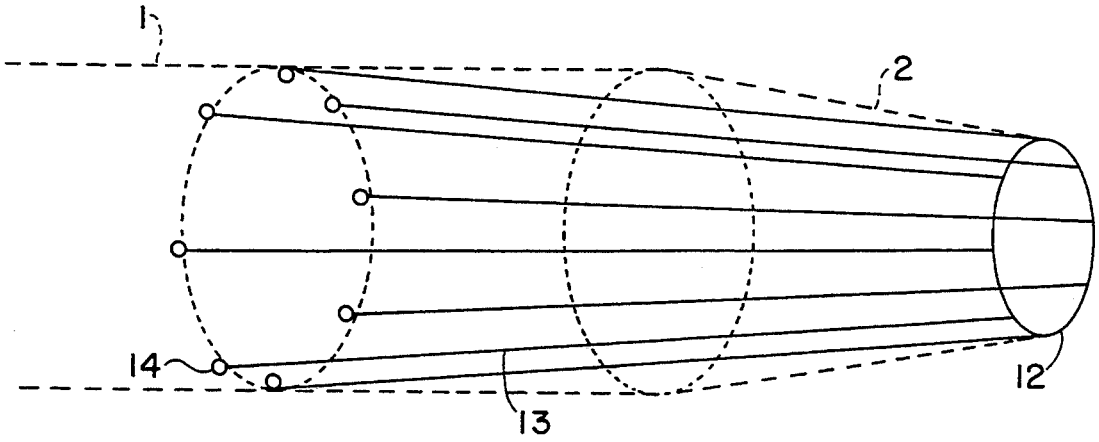
FIG. 2 is a schematical view of tensioning a solid annulus at the tail of the tow bag target shown in FIG. 1 in order to avoid oscillation.

The cylindrical tow bag target 1 shown in FIG. 1 is provided with a conical tail 2 at the end thereof an air exit orifice 9 is mechanically reinforced by a solid ring or annulus 12 the arrangement of which is shown in FIG. 2. The tow bag cylinder 1 is pulled by means of pulling strings 3 fastened at its front side and provided with the air entrance orifice and forming the so-called spider. These pulling strings 3 run to a rope coupling 4 where they are concentrated, and this coupling provides the connection to the tow rope 5 pulled by a towing air-craft. Because of the static pressure the tow bag is inflated by the air flow 6 and forms the front side air entrance orifice 7.

At the tail of the tow bag target the greatest portion of the impinging air flow is streaming in a cycling flow 8 about the outer wall of the tow bag and is mixed without raising great turbulences with the axial parallel through flow 10 leaving the air exit orifice 9. For the pendulumlike stabilisation of a constant flight condition about the longitudinal axis the shot sensor electronic device is not positioned in an axial location 11.

FIG. 2 shows the tensioning equipment of a solid annulus 12 in the air exit orifice by which oscillations can be avoided. This tensioning equipment consists of tension ropes or bands 13 which are fixed to the cylindrical wall of the tow bag target by fastening elements 14, for instance eyelets. Position and configuration of the conical tail 2 are stabilized by that tensioning equipment.

Figure 3:
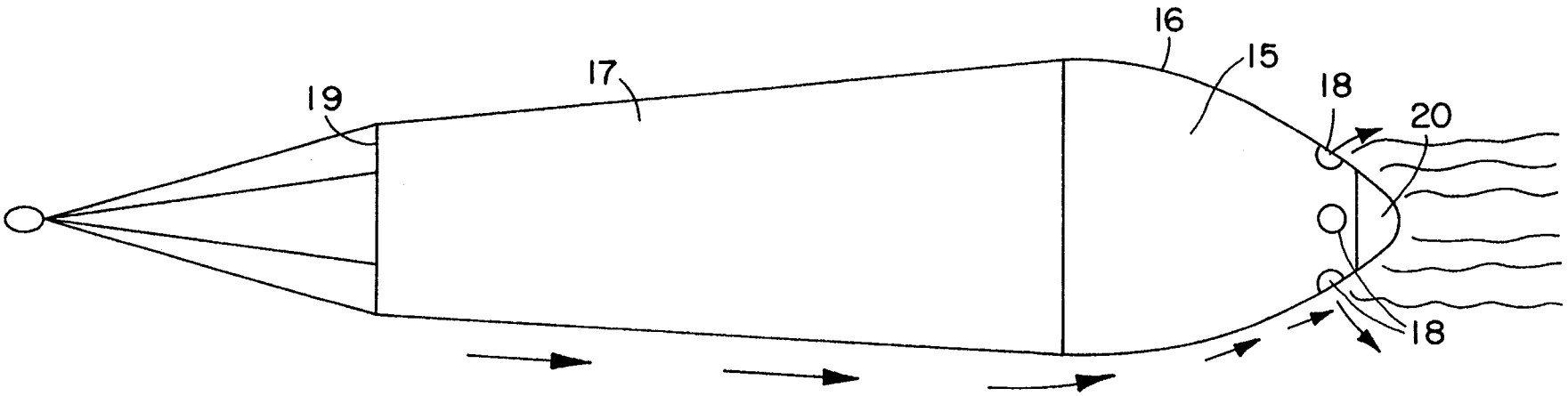
FIG. 3 is a schematical lateral view of a conically configured tow bag target provided with a rotational-elliptical contour of its tail with several air exit orifices at the tail positioned on an annulus in an axial symmetrical configuration.

FIG. 3 shows another embodiment of the tow bag target which is provided with a conical configuration 17 instead of a cylindrical one and consists of a practically airtight textile material. The tail 15 has not a conical but a rotational-elliptical tapering contour 16. The air entering the bag through the frontside air entrance orifice 19 accumulates within the bag and leaves the bag through several axial-symmetrically positioned air exit orifices having the configuration of holes 18 located in the wall of the bag in the rear third of the tapering contour 16. In this area the tow bag is provided with a semi-airtight rear wall 20.

At least in case of the embodiment according to FIG. 1 the tow bag target consists of a textile material the main direction of its web threads extends axially.

The two embodiments according to FIG. 1 as well as FIG. 3 fulfill, moreover, the condition that the hole area of the air exit orifices 9, 18 is smaller than the cross section of the frontside air entrance orifices 7, 19.

Because of the converging tapering contour 15 of the tail of the tow bag target, the turbulence of the air flow in the range of the tail and thus the air resistance or drag are essentially reduced so that the usefulness of the tow bag target is essentially improved. This usefulness depends substantially on the tensile strength of the tow ropes and the power reserve of the engines or fuel consumption of the towing air-craft, i.e. factors depending on the drag.

We claim:

1. In a high speed, reduced drag, aerial tow bag target of textile material having a longitudinal axis, a front end defining an air entrance orifice, and a rear and defining an air exit, the improvement comprising:

said rear end having a reducingly tapering contour along said longitudinal axis from front to rear and a rear end wall;

said air exit being formed by a plurality of axially directed holes formed in the rear third of said tapering contour within the wall of the tow bag and symmetrically arranged about said longitudinal axis; and the area of said air exit being less than the area of said air entrance orifice.

2. In a high speed aerial tow bag target of textile material having reduced aerodynamic drag including a front end air entrance orifice and at least one exit orifice at its rear end, the improvement comprising:

the tail of the tow bag target having a contour tapering to the rear end of the target and a netlike web forming said exit orifices, the entire area of the air exit orifices being less than the area of the front end air entrance orifice.

3. In a high speed aerial tow bag target of textile material having reduced aerodynamic drag including a front end air entrance orifice and at least one exit orifice at its rear end, the improvement comprising:

the tail of the tow bag target having a contour tapering to the rear end of the target and a netlike lattice forming said exit orifices, the entire area of the air exit orifices being less than the area of the front end air entrance orifice.

4. In a high speed aerial tow bag target of textile material having reduced aerodynamic drag including a front end air entrance orifice and at least one exit orifice at its rear end, the improvement comprising:

the tail of the tow bag target having a contour tapering to the rear end of the target, the entire area of the air exit orifices being less than the area of the front end air entrance orifice, the area of the air exit orifices being stabilized in configuration by a solid annulus kept under tension by tensioning strings fixed to the wall of the tow bag.

5. High speed aerial tow bag target according to claim 4, characterized in that the solid annulus is sewn into the tail of the tow bag.

* * * * *